US005827057A

United States Patent [19]

Cress

[11] Patent Number: 5,827,057

[45] **Date of Patent: *Oct. 27, 1998**

[54] VACUUM FURNACE METHOD AND APPARATUS

[76] Inventor: Steven B. Cress, 31 Lakefront Dr.—Box 30, Glenbrook, Nev. 89413

[ * ] Notice: The term of this patent shall not extend beyond the expiration date of Pat. Nos. 5,256,061 and 5,416,967.

[21] Appl. No.: 499,824

[22] Filed: Jul. 10, 1995

[51] Int. Cl.[6] ..... F27B 5/04; F27D 15/02; F27D 5/00

[52] U.S. Cl. ..... 432/205; 432/245; 432/253; 432/77

[58] Field of Search ..... 432/33, 65–77, 432/82, 135, 200, 205, 238, 242–245, 253

[56] References Cited

U.S. PATENT DOCUMENTS

| | | | |
|---|---|---|---|
| 2,644,736 | 7/1953 | Atchison | 432/65 |
| 3,020,032 | 2/1962 | Casey | 432/205 |
| 4,188,519 | 2/1980 | Berg | 432/82 |
| 4,472,622 | 9/1984 | Satoh et al. | 432/205 |
| 4,736,608 | 4/1988 | Laws et al. | 432/65 |
| 5,256,061 | 10/1993 | Cress | 432/205 |
| 5,416,967 | 5/1995 | Cress | 29/436 |
| 5,571,010 | 11/1996 | Okase | 432/242 |

*Primary Examiner*—William Doerrler
*Attorney, Agent, or Firm*—Herbert C. Schulze

[57] ABSTRACT

A vacuum furnace method and apparatus including unique heat dissipation means and methods, including reduced area of the vacuum chamber extension, heat reflecting discs, and unique cooling methods, wherein the vacuum furnace is constructed and operated at a small fraction of the previously known vacuum furnace costs.

4 Claims, 5 Drawing Sheets

FIG. 1
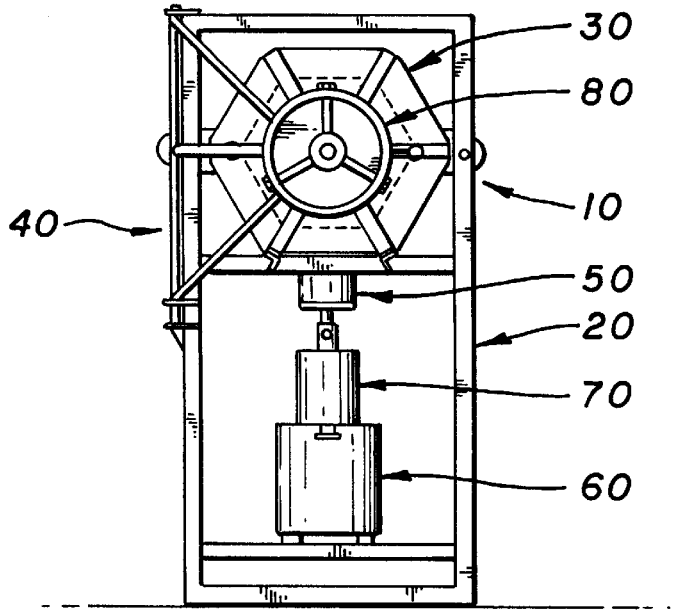
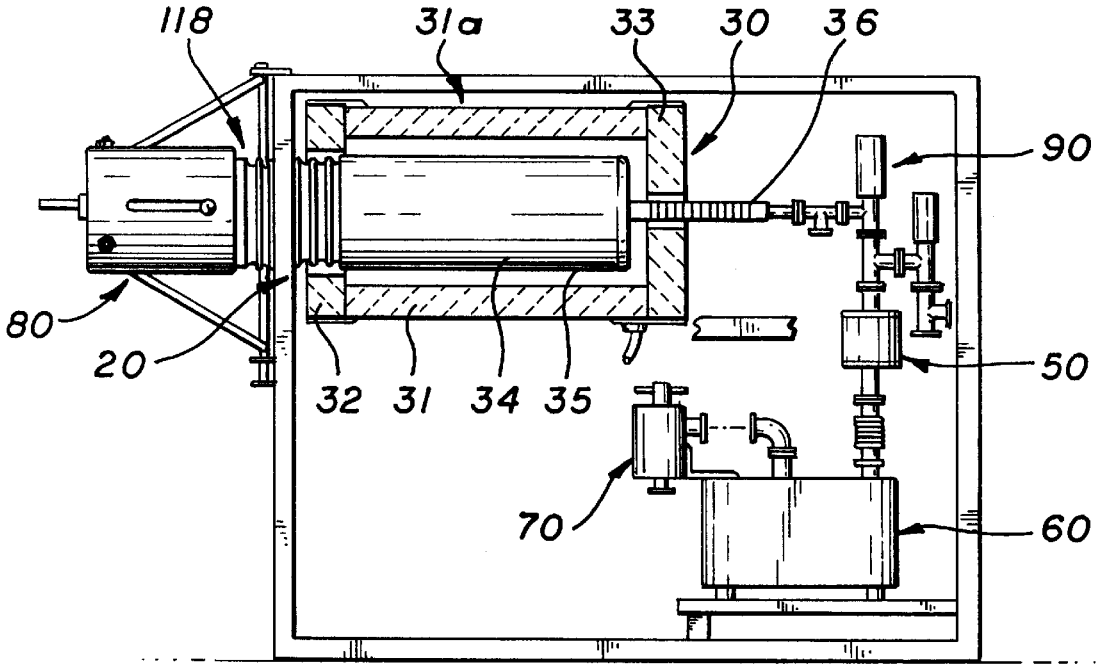
FIG. 2

VACUUM FURNACE METHOD AND APPARATUS

CROSS REFERENCE TO RELATED PATENT APPLICATIONS

This application is not directly related to any other application filed by me except that it is in the field of vacuum furnaces and the like and my presently application for *Method and Apparatus for Vacuum Furnace with Self Sealing Expansion Door Members*, Ser. No. 08/121,179 filed Sep. 14, 1993, now U.S. Pat. No. 5,416,967 is in that field.

BACKGROUND OF THE INVENTION

I. Field of the Invention

This invention is in the general field of vacuum furnaces and the like;

The invention is even more particularly directed to a unique Vacuum Furnace and method, wherein heat control is accomplished in a unique manner involving special heat dissipating areas about the door and coolant inlet areas, and;

The invention is even particularly directed to unusual coolant vanes and other arrangements.

II. Description of the Prior Art

There are many types of vacuum furnaces. Until the development of my Vacuum Furnace, as described in my U.S. Pat. No. 5,256,061, and my aforementioned application Ser. No. 08/121,179, now U.S. Pat. No. 5,416,967, all vacuum furnaces were essentially alike, and very costly. My present invention is different from the previously known structures, including the furnace of my afore mentioned patent and application. The present invention incorporates new heat dissipation methods and is different from those previously known In this sense, I know of no prior art as to this invention.

SUMMARY OF THE INVENTION

Vacuum Furnaces are widely used for heat treating various materials to impart special qualities to the material. A great number of vacuum furnaces are used in machine shops, where machined metal parts are treated to give them the desired qualities of hardness, and the like.

There are large numbers of vacuum furnaces, previously conceived, and/or being marketed. The use of, and value of vacuum furnaces is well known to those skilled in the art. Vacuum Furnaces, heretofore known (prior to my previously referenced patent and pending application) have had the common defect that they are extremely expensive, both in initial cost and in operating expenses. Thus, small machine shops and the like cannot afford them.

My previously described inventions have been a great improvement in this field. The present invention far outweighs any previous vacuum furnace. The present invention now provides a superior, and cost and time effective, vacuum furnace, which even modest machine shops can afford.

I have accomplished the desired end, primarily, by a number of unique heating and cooling devices and methods. These include unusual cooling vanes and circulation arrangements, as well as unusual vane heat arresting devices and the like.

It is an object of this invention to provide a method and apparatus for a Vacuum Furnace which includes the use of special cooling and heat transfer arrangements, as well as special chamber constructions and closures.

The foregoing and other objects and advantages of this invention will be apparent to those skilled in the art upon reading the description of a preferred embodiment, which follows, in conjunction with reference to the appended drawings.

BRIEF DESCRIPTION OF THE DRAWINGS

FIG. 1 is a front end plan view of a device suitable to practice the method of this invention;

FIG. 2 is a top elevation on FIG. 1 with portions partially broken away and in section;

DESCRIPTION OF A PREFERRED EMBODIMENT

Figure 3:
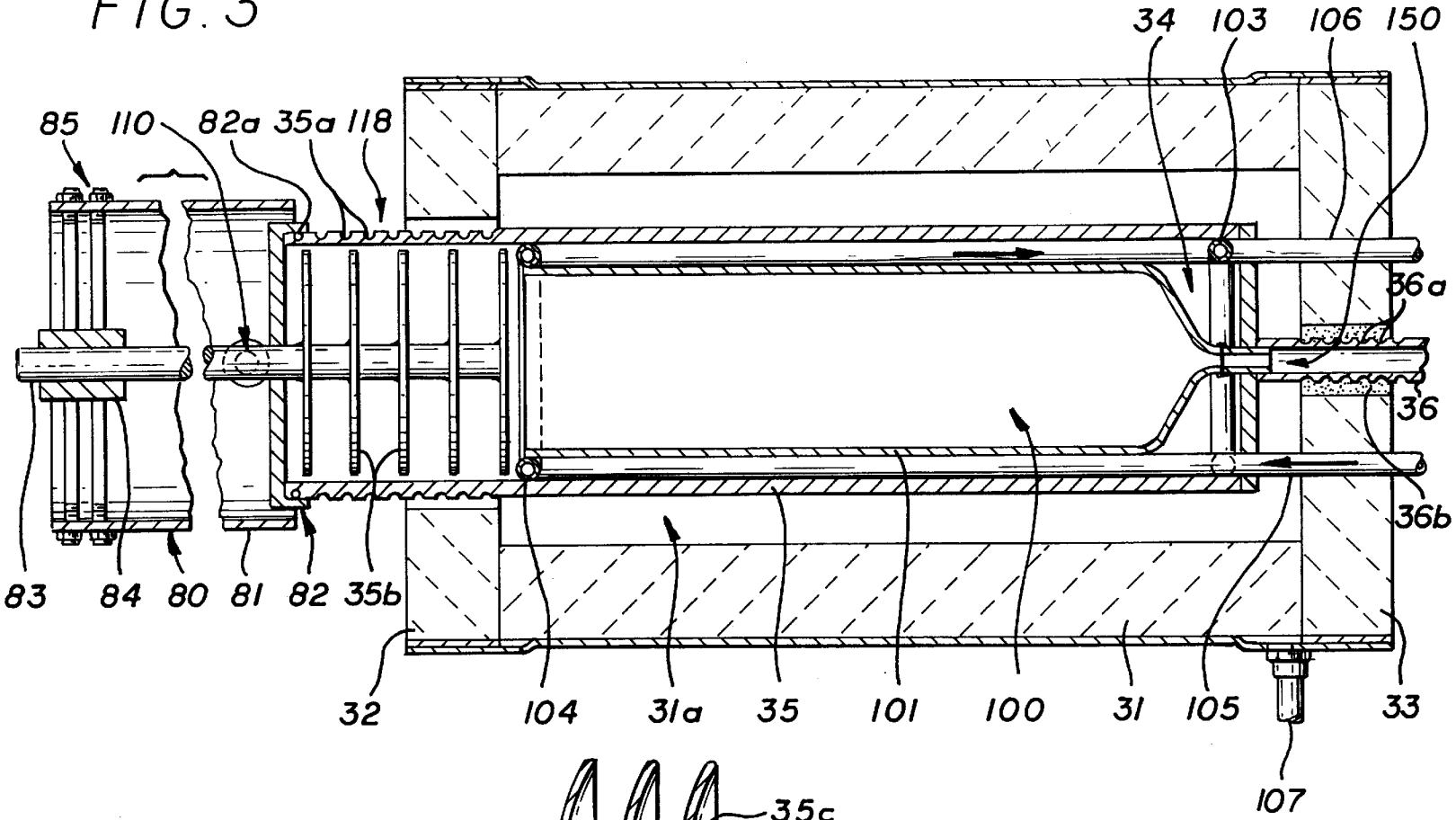
FIG. 3 is an enlarged schematic, partially sectioned and broken away view of a modification of a portion of FIG. 2.

FIG. 1 is a front end view, and FIG. 2 is a side elevation, partially sectioned, of a vacuum furnace, generally 10, suitable to practice the method of this invention. The elements shown include a framework 20, resting on a suitable surface such as a floor, or the like.

The furnace, generally 30, is shown. The furnace chamber 34 has a thin wall 35 (in this case, a round cross section, although other configurations could be employed if desired). The chamber is at a spaced distance from the walls 31, 35 of a heating chamber 31*a*. The front of the heating chamber is at the same horizontal location as the inside front of the chamber 34.

The door closure mechanism 80 is shown in its closed position. The coolant connections and accessories 90 are connected to the chamber through conduit 36.

Vacuum pump 60 is connected through controls 50 and piping 90. Filtration and the like is through customary apparatus 70.

Figure 10:
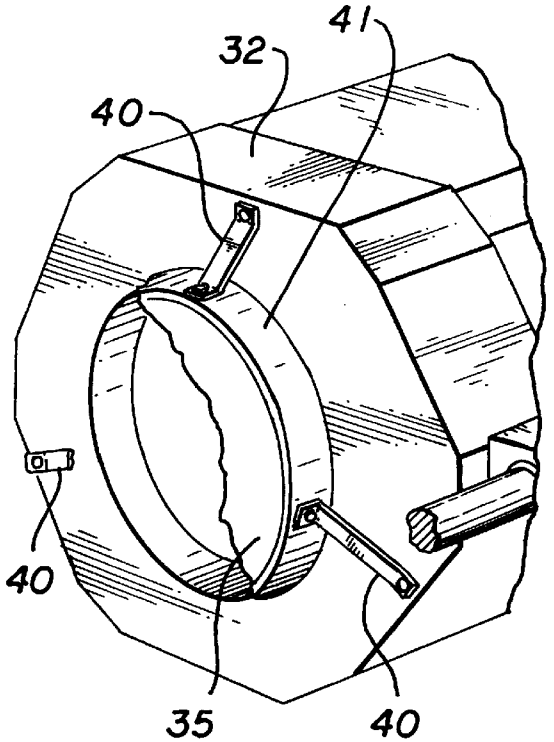
FIG. 10 is a partially broken away schematic perspective illustrating support mechanism for the furnace throat.

FIG. 10 shows the supports 40 and collar 41 for holding the front of the vacuum tube in a stationary position. Turning now to FIG. 3, the details of the chambers and connections to door and exhaust mechanisms are revealed. Additionally, in FIG. 3 an optional inner secondary chamber 100 is shown.

First I will address the primary features. The overall features of vacuum chambers are well know to those skilled in the art. Therefore I intend primarily to address only those features which are unique to the present invention. The vacuum chamber 34 is the area in which the articles being treated are placed. In this case, if the optional inner chamber 100 is being used, then, the articles being treated will be placed in the optional inner chamber. There will be heating arrangements, well known to those skilled in the art in the area 31*a*. These have not been detailed, since they are generally customary, and may be electrical, gas, oil, or the like, and are well known to those skilled in the art.

Figure 4:
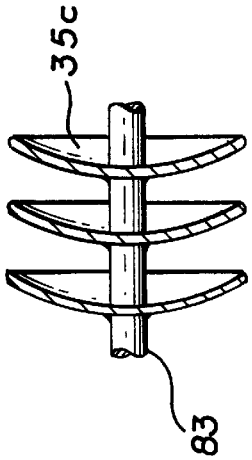
FIG. 4 is a partial, partially sectioned, view of an alternate embodiment of heat reflectors used in FIG. 4.

The unique features of this invention include, without limitation, the interior chamber 34, having walls 35, including, importantly, unique heat dissipating grooves 35*a* and heat reflectors 35*b*. The heat reflectors are discs of any suitable material which will withstand the heat generated. The reflectors 35*b* reflect the heat to the chamber, and away from the door seal area 82. In an important variation, these heat reflectors may be parabolic, or otherwise shaped, as shown at 35*c* in FIG. 4. In this case, the reflectors enhance the heating within the chamber, and decrease the heat at the sealing area 82.

Figures 7, 8:
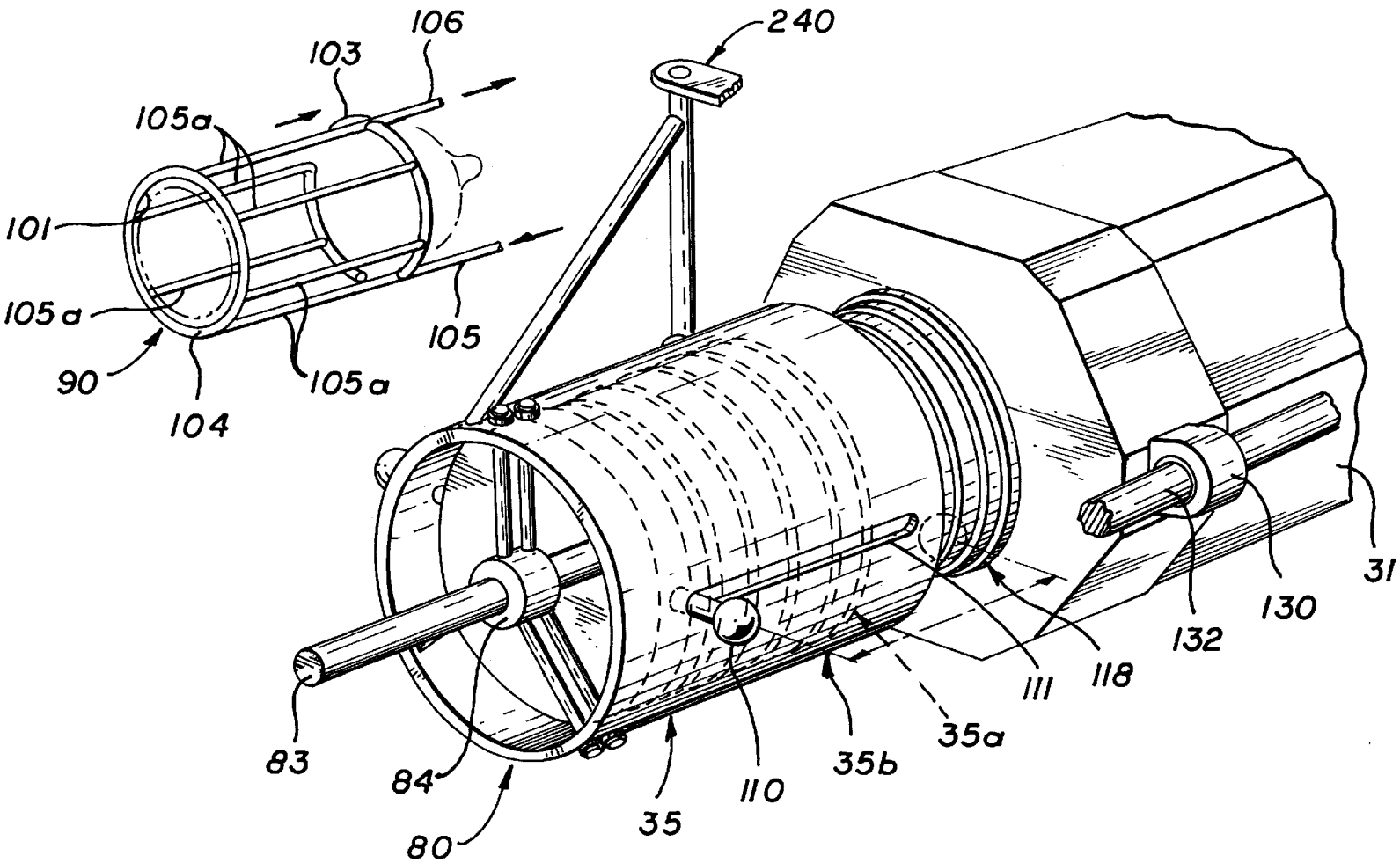
FIG. 7 is a partially broken away perspective of the door element shown in FIG. 5.
FIG. 8 is a schematic view of an alternate cooling arrangement for the device.

In the optional modification, an inner chamber 100 having thin walls 101, and exhaust stem 102 is shown. This chamber fits within the chamber 34, and may carry a manifolded cooling and exhaust arrangement 90 as shown in FIG. 8. This manifolded arrangement comprises round tubes 103 and 104 connected by multiple tubes 105*a* surrounding the optional chamber wall 101. The manifold receives coolant through tube 105, and the discharge of the coolant, which may be in a vaporized state is through tube 106. The interior of the optional chamber 100 will have an exhaust at 150 into central exhaust 36.

Figure 5:
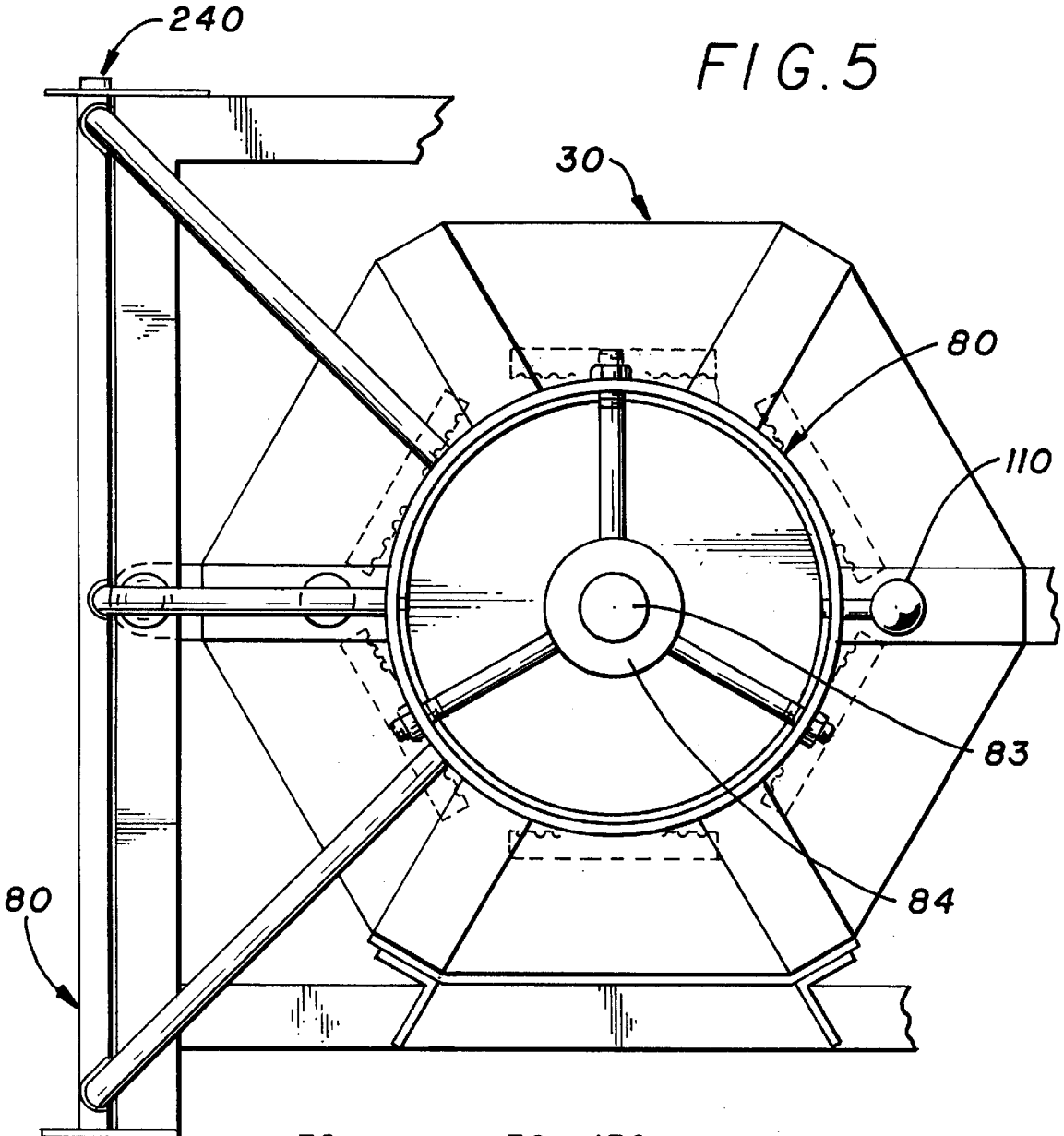
FIG. 5 is an enlarged front end view of the door element of this invention.

FIG. 5, which is an enlarged partial front end view will be helpful, only because of some engineering details, not otherwise shown.

Figure 6:
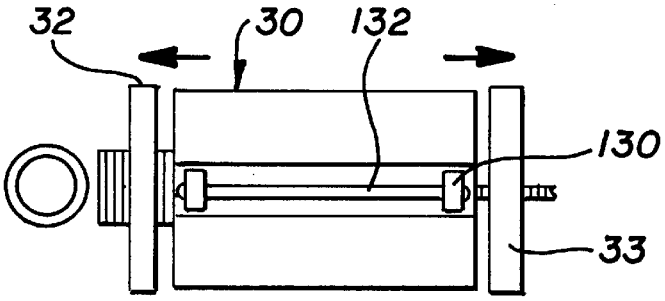
FIG. 6 is a schematic side elevation of the device, in reduced scale, indicating the travel of the elements due to expansion and contraction, and for opening at the front and back for rapid cooling.

FIG. 6, shows how it is possible separate the ends of the heating chamber from front and rear walls 32 and 33 and through lineal bearing members 130 and 132 as will be clear to those skilled in the art. Additionally the lineal bearings support the chamber and its ends as expansion and contraction occurs during the heating and cooling cycles.

FIG. 7 shows the door closure, previously touched upon, but deserving of particular attention. The door closure 80 is of an unusual nature—and therein lies its unique character. the door closure is a cylinder 81 with an end cap 82 with a seal 82*a*. The closure has a rod 83, upon which the heat reflectors 35*b* are mounted. A handle 110 fastened to the rod 83 moves through slot 111 to allow cap 82 and the reflectors 35*b* to be drawn in or out of the throat of the chamber wall 35. When in the outer position, the closure will be pivoted about pivot 240 to swing out of the way, leaving the chamber opening unobstructed.

Figure 9:
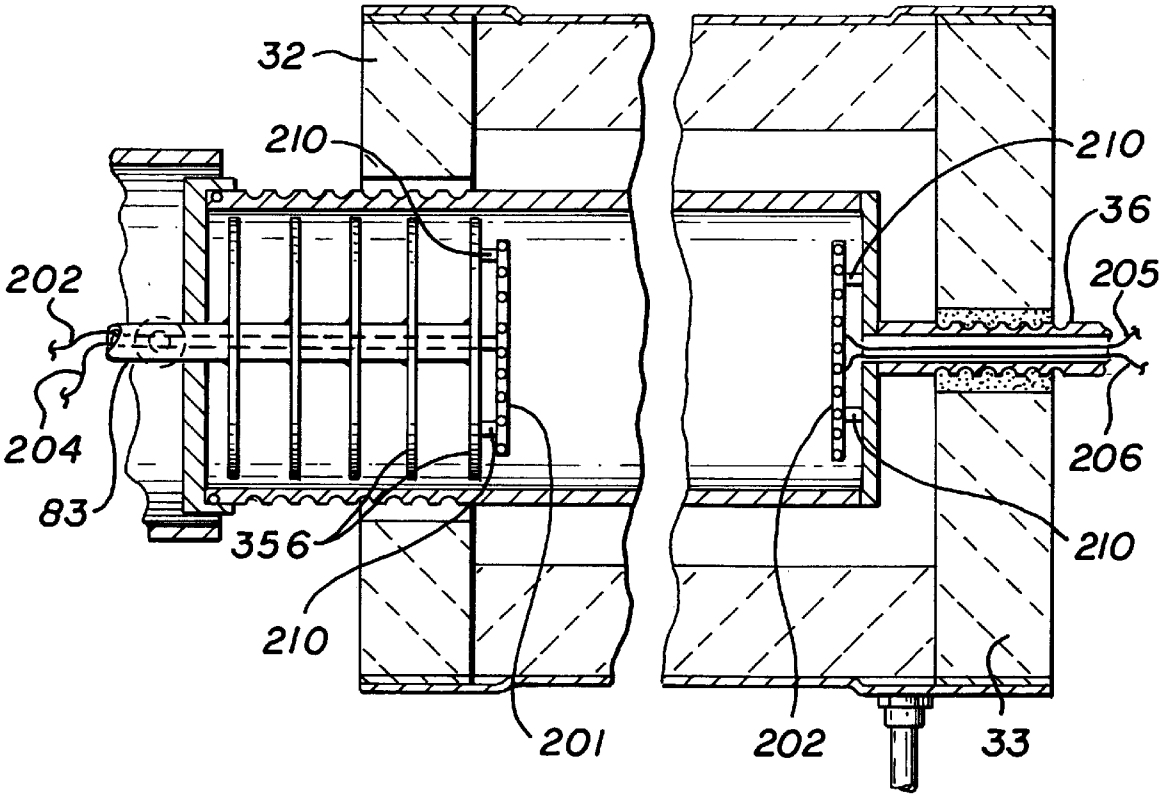
FIG. 9 illustrates an alternate embodiment of the front and rear heat reflector areas for ensuring heat uniformity on large models of the furnace.

FIG. 9 shows the additional heating elements 201 and 202, fastened to the reflector 35*b* and to the rear wall of the chamber by means of brackets or the like, known to those skilled in the art. These heaters receive power through electrical leads 202–204 and 205–206, which pass through rod 83 and tube 36. These auxiliary heaters will assist in securing uniformity of heat within the chamber on particularly large models of the furnace.

While the embodiments of this invention shown and described are fully capable of achieving the objects and advantages desired, it is to be understood that such embodiments are for purposes of illustration only and not for purposes of limitation.

I claim:

1. The method of dissipating heat along the throat of a vacuum furnace chamber comprising: forming a number of grooves about the outer diameter of a throat, which is an extension of the chamber, which grooves radiate heat because of their reduced diameter.

2. A vacuum furnace comprising in combination: a first heating chamber; a second curing chamber having a first open end and a second closed end within said first heating chamber, and having an extension extending through said first heating chamber, wherein said extension is provided with circumferential grooves to radiate heat; a closure removably inserted into said extension, said closure including heat reflecting discs; and coolant means associated with said first heating chamber and second curing chamber suitable to cool the interior of said second curing chamber.

3. The vacuum furnace of claim 2 wherein the heat reflecting discs are convex in shape.

4. The vacuum furnace of claim 2 wherein the heat reflecting discs are parabolic in shape.

* * * * *